United States Patent [19]

Lonati

[11] 4,233,826

[45] Nov. 18, 1980

[54] CONTROL DEVICE FOR STRIPER UNITS IN CIRCULAR KNITTING MACHINES

[75] Inventor: Francesco Lonati, Brescia, Italy

[73] Assignee: Construzioni Meccaniche Lonati S.p.A., Brescia, Italy

[21] Appl. No.: 950,411

[22] Filed: Oct. 11, 1978

[30] Foreign Application Priority Data

Oct. 21, 1977 [IT] Italy ..... 28877 A/77

[51] Int. Cl.[3] ..... D04B 15/60; D04B 15/80

[52] U.S. Cl. ..... 66/140 R; 66/234; 66/237; 66/139

[58] Field of Search ..... 66/14, 138, 139, 140 R, 66/234, 237

[56] References Cited

U.S. PATENT DOCUMENTS

| | | | |
|---|---|---|---|
| 2,290,058 | 7/1942 | Manger et al. | 66/140 R |
| 2,763,144 | 9/1956 | Briston | 66/14 |
| 3,022,652 | 2/1962 | Wainwright et al. | 66/14 X |
| 3,552,149 | 1/1971 | Lonati | 66/14 |
| 3,605,444 | 9/1971 | Lonati | 66/139 X |
| 3,823,578 | 7/1974 | Voda | 66/14 |
| 3,888,094 | 6/1975 | Lonati | 66/138 |

*Primary Examiner*—Wm. Carter Reynolds

*Attorney, Agent, or Firm*—Guido Modiano; Albert Josif

[57] ABSTRACT

A control device for striper units in a circular knitting machine having a plurality of cam disks, the profil whereof is followed by a respective lever operating a respective thread finger by means of a Bowden cable. Each cam disk is secured to a respective toothed wheel meshing with a further toothed wheel which may be coupled with and uncoupled from, a drive shaft constantly rotating with a predetermined rotational speed. Coupling and uncoupling of the further toothed wheel is controlled by the main chain of the machine so as to selectively cause a rotation of substantially 180° of a respective selected cam disk to bring the corresponding thread finger in operation and another rotation of substantially 180° to bring the corresponding thread finger out of operation. Other cam disks are provided to control in the same manner corresponding thread cutting and gripping means each time an associated thread finger is controlled.

8 Claims, 7 Drawing Figures

CONTROL DEVICE FOR STRIPER UNITS IN CIRCULAR KNITTING MACHINES

BACKGROUND OF THE INVENTION

This invention relates to a control device for striper units in circular knitting machines, in particular double-cylinder hosiery knitting machines.

It is known that a striper unit in a double-cylinder circular knitting machine, such as the one disclosed in U.S. Pat. No. 3,605,444 to Francesco Lonati, comprises a plurality of thread fingers for each machine feed, the various thread fingers being selectively movable to and from the needle cylinders in order to feed, or respectively remove, the respective threads every time that the knitting process requires replacement of a given thread with another thread of a different nature, denier or color. Associated with the thread fingers are one or more thread cutting means, which effect the cutting of the thread upon removal of the latter from the knitting cycle, and one or more thread gripping means, which are sometimes made integral with the cutting members, e.g. as disclosed in U.S. Pat. No. 3,552,149 to Francesco Lonati, which hold back the cut thread until it is reinserted in the knitting cycle.

Each striper unit may comprise up to five, six, or more thread fingers, for the movement whereof a control device is provided which is adapted for controlling the movement of the respective thread cutting and gripping means. The control devices currently known in the art have a very complex construction and a fairly small degree of versatility. A typical control device would comprise, in fact, a plurality of arcuate control levers rigidly mounted to a control shaft rocking about its own axis, which arcuate levers are adapted to engage and selectively advance respective toothed profile disks, to which other, but cam profiled, disks are rigid, whereby the movements of the respective thread fingers and thread cutting and gripping means are controlled by means of a lever and Bowden cable type of linkage system. To cause the simultaneous movement of the arcuate control levers to reflect in a selective action on the disks, provision is made for the presence of a rod having plural side notches and interposed projections of different heights, said rod being displaceable parallel to itself and influencing with its notches and projections, in conformity with its height, the various levers in their rocking motion, such that only one of them, namely the one selected in accordance with the program, becomes active on its related toothed disk. The displacement of the selecting rod is provided by a stepped sector, or segment, which steps are operative to engage an arm protruding from said rod according to necessity, the sector being controlled to rotate by the machine program.

A first drawback of such a control device resides in its inability to provide for simultaneous insertion in the knitting cycle of two or more thread fingers, as is the case with some special patterned knitwork. It is sometimes possible, with some special provisions, to obtain two simultaneous selections, but this is only limited to two particular thread fingers, i.e. it is impossible to combine at will the thread fingers that are to be brought into operation simultaneously.

Another drawback is that the toothed disks, being advanced by means of levers, must be provided with closely spaced teeth, e.g. for a total of six teeth, which restricts to a very small arc the extension of the cams controlling, at each advance increment, the thread fingers and cutting and gripping members. It follows that a structure of this type cannot meet the modern requirements for fast knitting, because if the disks are actuated too rapidly it may happen that the short cam profile thereof cannot be correctly followed by the corresponding linkages which control the thread fingers and the cutting and gripping members.

Moreover, the arrangement of several cam disks at each thread finger and cutting and gripping means, each disk having a distinctive peripheral contour, and the arrangement of several identical profiles on the same disk, owing to the short rotation imparted with each actuation, involve constructional difficulties and problems in timing the disks one with respect to the other, any minimal error in construction and timing being apt to reflect in a machine malfunctioning.

Such drawbacks are not substantially obviated by the device disclosed in U.S. Pat. No. 3,888,094 to Francesco Lonati. This device still provides for the presence of an arcuate lever for advancing a corresponding toothed disk, although the lever is actuated by a rotary member, in a manner similar to a crank-connecting rod system. The rotary member can be coupled and uncoupled controllably, at predetermined times, to a shaft held in constant rotation by the action of the machine drive means. In this device, a degree of constructional simplification is achieved, as is a more accurate intervention with respect to the previously described device, but the device still retains the problems, already mentioned above, relating to fast advance by very short portions of the toothed disks, as well as the timing problem, when several similar units are utilized for multiple thread fingers.

German Patent No. 973,500 to Gottlieb Eppinger K.G. discloses instead a device wherein actuation of a secondary thread finger, in or out of the knitting cycle, is obtained through a 180° respective rotation of a cam disk which can be coupled and uncoupled controllably to and from a constantly rotating shaft, and is followed by one end of a rocking lever, to the opposite end whereof there is a hooked a thread finger actuating cable. More in detail, the cam disk can be coupled and uncoupled by displacing the disk itself axially, the disk being idle mounted to the shaft and rigid with a coupling element, engageable by axial movement with a mating coupling member which remains rigid with the rotating shaft. Control is achieved through a rocking lever controlled by the machine programming chain, which lever, in one position, is active to release the coupling element under the action of a spring in engagement relationship with the coupling member which is rigid with the shaft, and in another position, disengages it from that member against the spring bias.

This device affords a more accurate intervention, since it has a 180° arc available for each control actuation, whereby it is also suitable for use in high speed machines. However, it is unsuitable for application where selective operation of several thread fingers is required, because each of these would then require an axial coupling system, with its attendant spring and control lever, of its own, thus rendering the device a bulky one, which is unpractical on machines which are known to allow but a limited space for the various controls.

SUMMARY OF THE INVENTION

To obviate such difficulties, and overcome the limitations of conventional control devices for striper units, the instant invention sets out to provide a control device for striper units as specified above, which comprises a relatively small number of component parts, while ensuring a higher degree of selectivity than the prior art devices, it being capable of simultaneously actuating any number of thread fingers selected at will among those of a given thread feed.

It is a further object of the invention to provide a device as indicated, which is reliable in operation even at high knitting speeds, and which is of simple construction, and moreover of a size suitable for inclusion in a smaller space than the space occupied by the prior art devices.

These objects are achieved, according to the instant invention, by a control device for striper units in circular knitting machines, in particular double-cylinder hosiery knitting machines, wherein the individual thread fingers of the striper unit are selectively controllable in and out of operation by means of corresponding cam disks mounted for idle rotation on a common shaft and selectively caused to advance rotatively as required by the machine knitting program, the device being characterized in that each cam disk is axially non-displaceable along said common shaft and is made rigid with a respective rotatively actuating member in constant engagement with a respective actuator element arranged, in a manner known per se, on a drive shaft rotating at a rotational speed bearing a predetermined speed ratio to the rotational speed of the needle cylinder(s), said actuator elements being selectively engageable for rotation with said drive shaft in accordance with the machine knitting program, individually and for predetermined time lapses wherein the respective thread fingers are brought in or out of operation.

In a device so constructed, which does away with the need for arcuate toothed disk actuating levers, and wherein the movement is imparted to the cam disks rotatively by coupling and uncoupling a cylindrical actuator element with a rotating shaft, it becomes possible to select at will any number of thread fingers, and all of them if desired, with the added advantage of a simple and compact structure. Furthermore, the cam disks can be designed with a more straightforward profile contour, it being sufficient that each disk be provided with a profile having but two portions located at different distances from the axis, whereby an extended disk arc is made available for the thread finger movement. This makes the operation at high speeds more reliable.

Advantageously, to actuate the cutting and gripping means, as many cam disks may be provided, being each rigidly mounted to the actuating member provided for controlling the respective thread finger, thus obtaining a specially compact structure and ensuring for the entire device an exceptionally high degree of versatility.

BRIEF DESCRIPTION OF THE DRAWINGS

Further features and advantages of the invention will be more clearly apparent from the following detailed description of a preferred embodiment thereof, given herein by way of example only and illustrated in the accompanying drawings, where.

DESCRIPTION OF A PREFERRED EMBODIMENT

Figure 1:
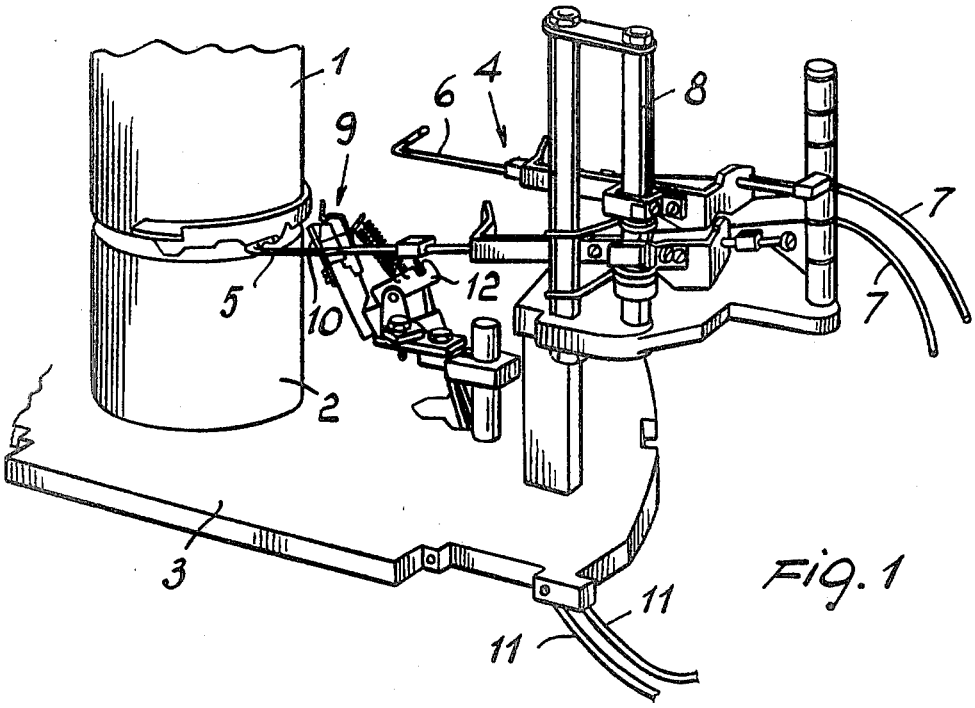
FIG. 1 is a perspective view of a portion of a double-cylinder hose-knitting circular machine having a striper unit and a cutting and gripping assembly, the striper unit being represented with but two thread fingers for clarity sake.
Figure 2:
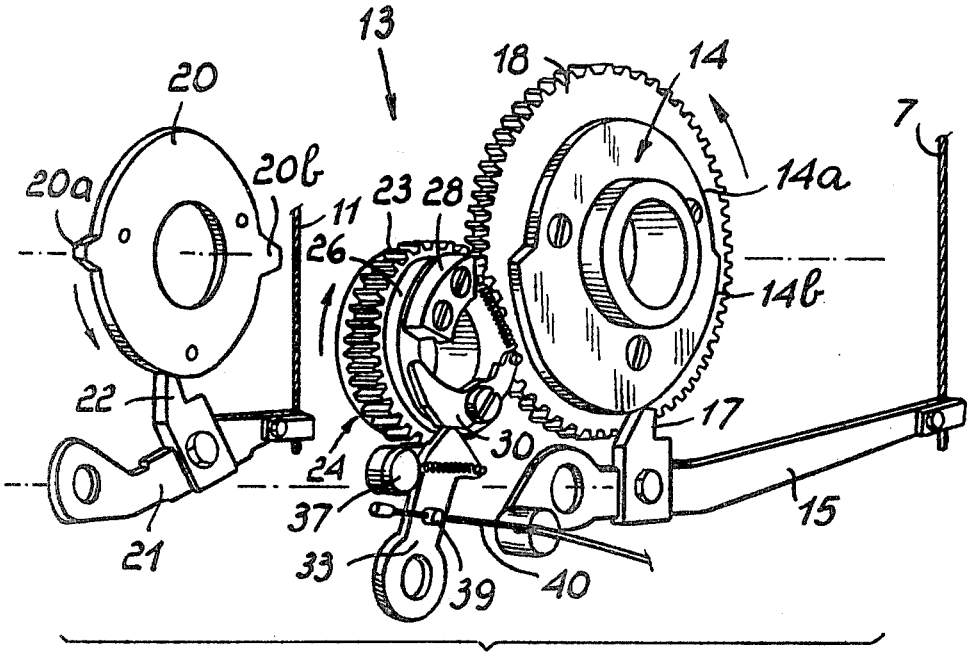
FIG. 2 shows in perspective a detail of the control device according to the invention.

In FIG. 1, there are shown schematically and indicated at 1 and 2 the two rotatable needle cylinders of a double-cylinder knitting machine having at least one thread feed, the numeral 3 denoting a portion of the stationary structure of the machine, which carries at least one striper unit 4 of conventional design, e.g. similar to the one described in U.S. Pat. No. 3,605,444 cited above, the unit including, for clarity reasons, but two thread fingers 5 and 6, the former shown in its operative thread feeding position and the other in its inoperative thread with drawing position. Actuation of the thread fingers is implemented, as provided by said Patent, by means of Bowden cables 7, which are secured, at one end to the rod of the respective thread finger, and at the other end to the control device, to be described hereinafter. A pull force applied to the cable 7 causes, in a manner known per se, the respective thread finger to initially withdrawn radially out of the needle cylinders, against the bias of a first spring, and then rotate about its support 8 against the bias of a second spring, to its rest or inoperative position. By contrast, release of the cable 7 brings about the returning of the thread finger to its operative position through a reverse movement.

A thread cutting and gripping assembly is indicated at 9, which is of the type described in the cited U.S. Pat. No. 3,552,149, or in U.S. Pat. No. 4,099,392 to Francesco Lonati, and is carried by the portion 3 and equipped with as many independent cutting blades 10 as are the thread fingers, the blades being actuated by a pull through respective Bowden cables 11 attached, at one end to the control levers 12 of the respective cutting blades, and at the other end to the control device.

This device will be explained hereinafter with reference to a single thread finger and single thread cutting and gripping member, it being obvious that the complete device will include as many basic or elementary such devices, identical to the one described herein, as are the thread fingers.

An elementary control device 13 according to the invention comprises a first cam disk 14 for actuating a control lever 15 of a thread finger, whereto is hooked, with one end, the respective Bowden cable 7, the sleeve or case whereof is obviously attached to a stationary portion of the machine. The lever 15 is journalled, with its other end, to a shaft 16 (FIGS. 4,5,6, and 7) and is provided with a cam follower tooth 17 held in engagement with the profile of the disk 14. The latter is formed with a recessed portion 14*a* and raised or projecting portion 14*b*, which extend substantially over half of its circumference each. The disk 14 is rigid with a rotary actuating member, advantageously represented by a toothed wheel 18, mounted for idle rotation together with the disk 14 on a common shaft 19 (FIG. 3), which is carried, e.g. horizontally, by the rear portion of the machine. The disk 14 and the actuating member 18 are axially non-displaceable on the common shaft.

To the toothed or gear wheel 18, there is further attached, on the opposite side to the disk 14, a second cam disk 20 for actuating a control lever 21 intended to control a respective cutting blade 10. The lever 21 is journalled at one end to the shaft 16, and has a cam follower tooth 22 engaging the profile of the disk 20, while with its free end, the lever 21 is secured to one end of its respective Bowden cable 11, the sleeve whereof is obviously attached to a stationary portion of the machine. The cam disk 20 has two projections or lobes 20*a* and 20*b* which are substantially opposite to each other and of trapezoidal shape, the projection 20*a* having a smaller height than the projection 20*b*, for reasons that will be explained hereinafter. The disk 20 is attached to the toothed wheel 18 at an angular position such that the two opposite projections 20*a* and 20*b* are located substantially at the angular points whereat the projecting portion 14*b* of the disk 14 begins and ends.

The toothed wheel 18 is in constant mesh engagement with a toothed wheel 23 of a cylindrical revolvable actuator element 24, mounted on a drive shaft 25 (FIG. 3) and engageable therewith upon command by the machine program, at and for predetermined times through suitably provided coupling means. The shaft 25 is driven to rotate constantly at a rotational speed in a predetermined ratio to the rotational speed of the needle cylinders 1 and 2. In particular, in the example shown, the rotatable drive shaft 25 is caused to rotate at a speed such as to complete one revolution at each revolution of the cylinders 1 and 2, the ratio between the toothed wheels 18,23 being 2:1.

According to a specially advantageous embodiment, the actuator element 24 comprises a disk 26 formed integral with the toothed wheel 23 and idly carried by the shaft 25 through bearings 27. On one face of the disk 26, an arcuate plate 28 is mounted rigidly which is operative to engage slidably in an annular groove 29 of the shaft 25 such as to prevent the actuator element 24 from moving axially along the shaft itself. Moreover, there is freely journalled to the disk 26, along a parallel axis to the axis of the disk 26, a contoured ratchet lever 30 which is provided, on one side of its pivot axis, with a small inner tooth 31 adapted for engaging, upon command, a recess 32 in the shaft 25, and on the opposite side, with a gradually increasing radius outer corner edge 30*a*, intended for engaging the end of an anchor 33, which is journalled with its other end to a fixed pivot pin 34. Normally, the ratchet lever 30 is held with the edge 30*a* in engagement with the end of the anchor 33 through a spring 35, stretched between the end of the ratchet lever 30 next to the small tooth 31 and a dowel pin 36 rigid with the disk 26, while the anchor 33 is usually held in position against a stop 37 by means of a spring 38, stretched between the anchor 33 and the stop itself. Thus, in normal conditions, as shown in FIG. 4, the ratchet lever 30 is kept with its small tooth 31 out of the recess 32, thereby disengaging the actuator element 24 from the rotating shaft 25 and is stationary with respect thereto.

A small pin 39 is attached to the anchor 33, whereto is hooked, with a slight play, one end of a Bowden cable 40, the other end whereof engages one end of a rocking lever 41, the latter being provided with a tooth-like opposite end 42 effective to follow corresponding projections 43 arranged in accordance with a predetermined program on the main chain of the machine, whereof only two links 44 are visible in the drawings, which runs around a sprocket wheel 45 in a conventional manner. The sleeve of the cable 40 is secured, respectively, to the end of the lever 15 away from the Bowden cable 7 and to a retainer attached to the stationary portion 3 of the machine. The chain together with its projections 43, lever 41, Bowden cable 40 and anchor 33 defines means for selectively coupling the actuator elements 24 with, and uncoupling from, the drive shaft 25.

To explain the operation of the device according to the invention, reference is made to FIGS. 4 to 7.

Figures 3, 4:
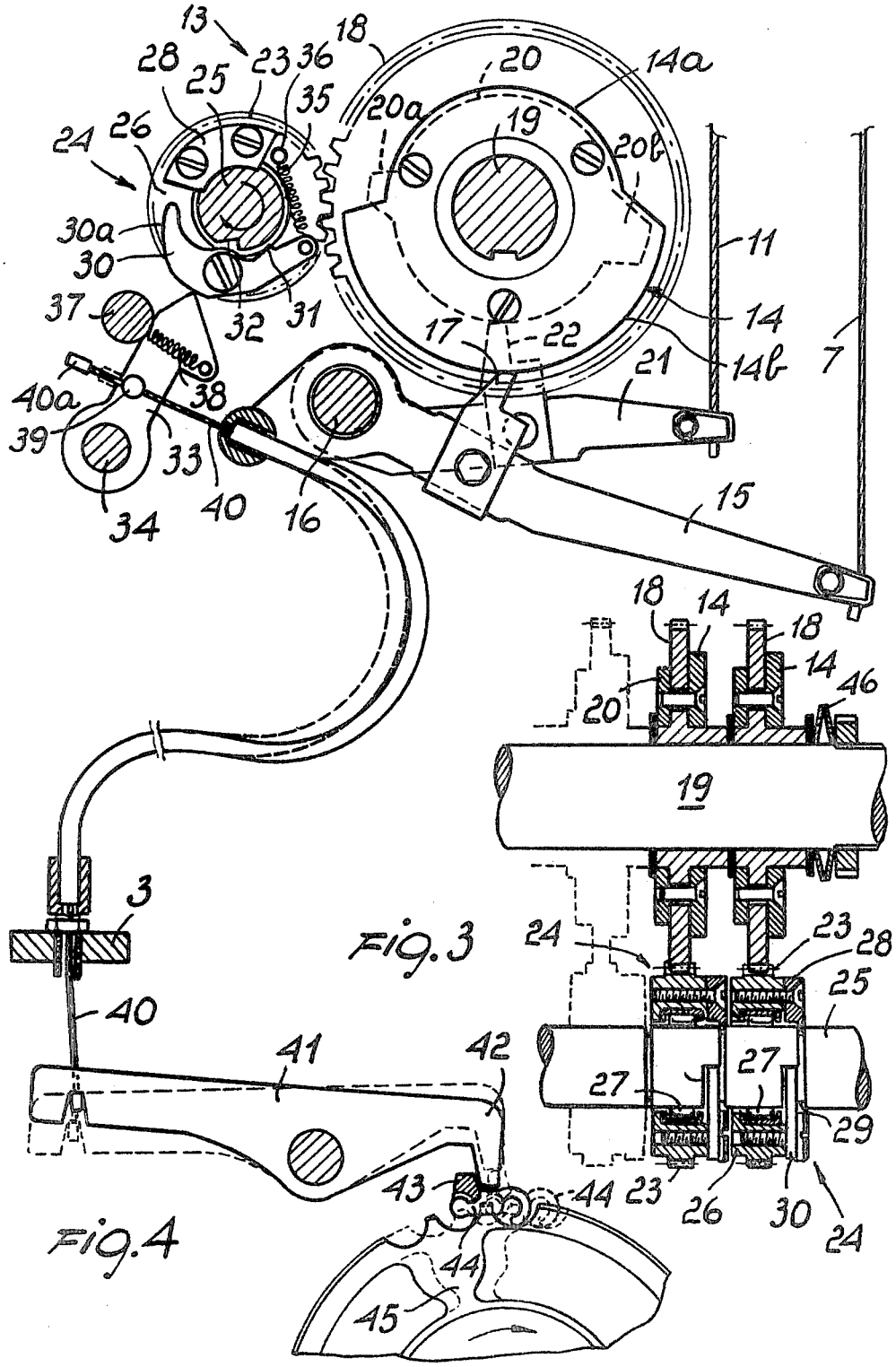
FIG. 3 is an axial sectional view of a portion of the control device according to the invention.
FIGS. 4,5,6, and 7 illustrate different operative stages or phases of the device according to the invention, which has been limited here to just one thread finger and related cutting and gripping member, again for clarity.

In FIG. 4, the control device 13 is shown at a position corresponding to a thread finger being in its inoperative thread withdrawing position. The tooth 17 engages the projection 14*b* of the disk 14, thereby the control lever 15 pulls on the cable 7 and the thread finger is in the position indicated at 6 in FIG. 1. The thread cutting member is also at a rest position, the blade 10 being withdrawn or retracted, and the thread retained in the gripping member in a manner known per se, since the tooth 22 of the lever 21 engages the lower or bottom portion of the disk 20 and the cable 11 is released. The actuator element 24 is disengaged from the rotating shaft 25, the ratchet lever 30 being engaged by the anchor 33. This situation, caused by the fact that on the main chain of the machine no projection 43 is provided at this time (consider the position of the lever 41 shown in full lines in FIG. 4), remains unchanged up to the moment when command is given to bring into an operative thread feeding position the thread finger.

However, should a projection 43 be provided, as indicated in dotted lines in FIG. 4, the device would not yet be actuated, and the lever 41 would just move into the position indicated in dotted lines, while the cable 40, which had its end block 40*a* slightly removed from the pin 39, would be pulled slightly, enough to bring the end block 40*a* to just touch the pin 39, as indicated in dotted lines, without any other effect; the reason for this will be made clear hereinafter.

Figure 5:
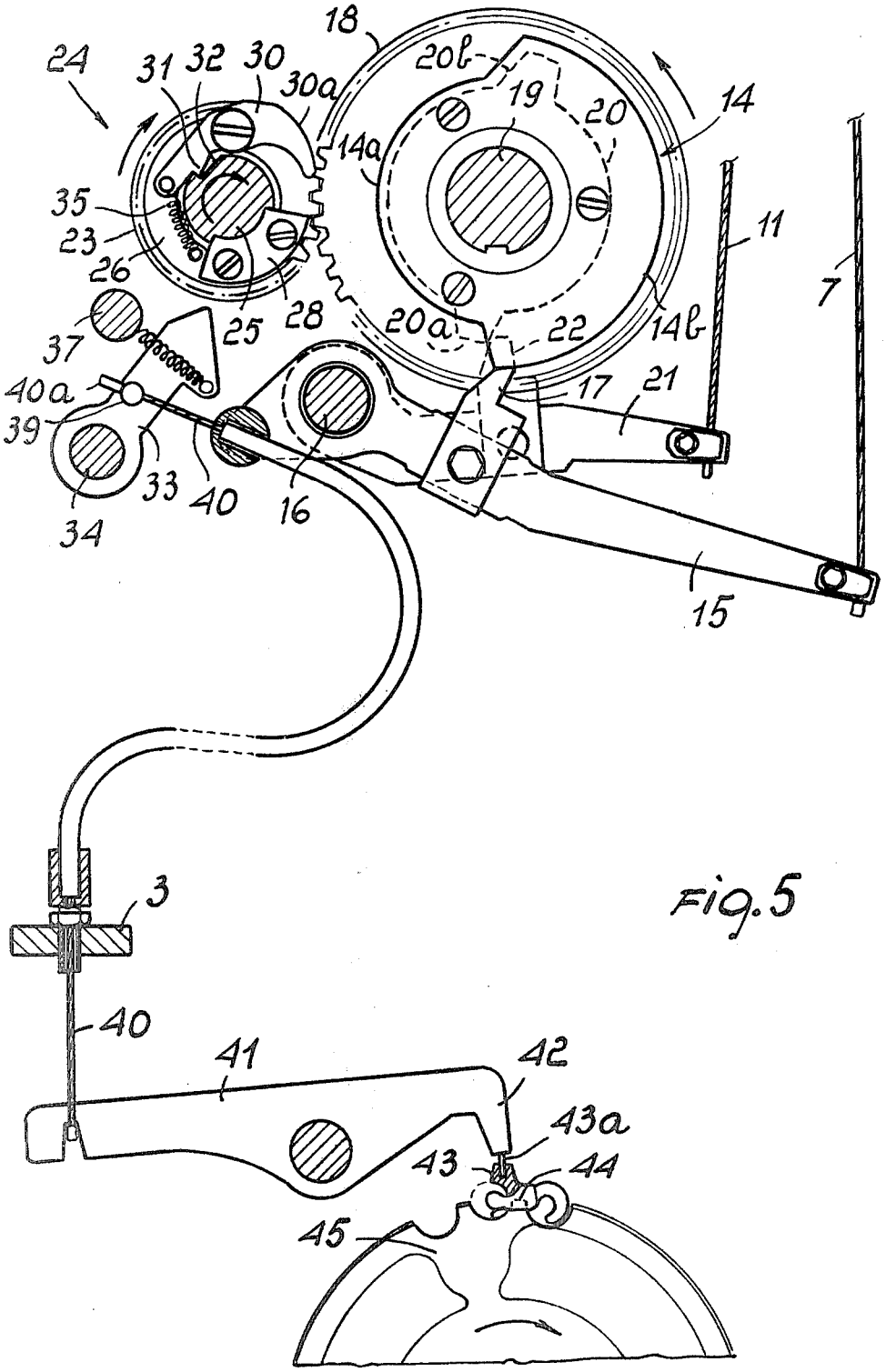
Figure 6:
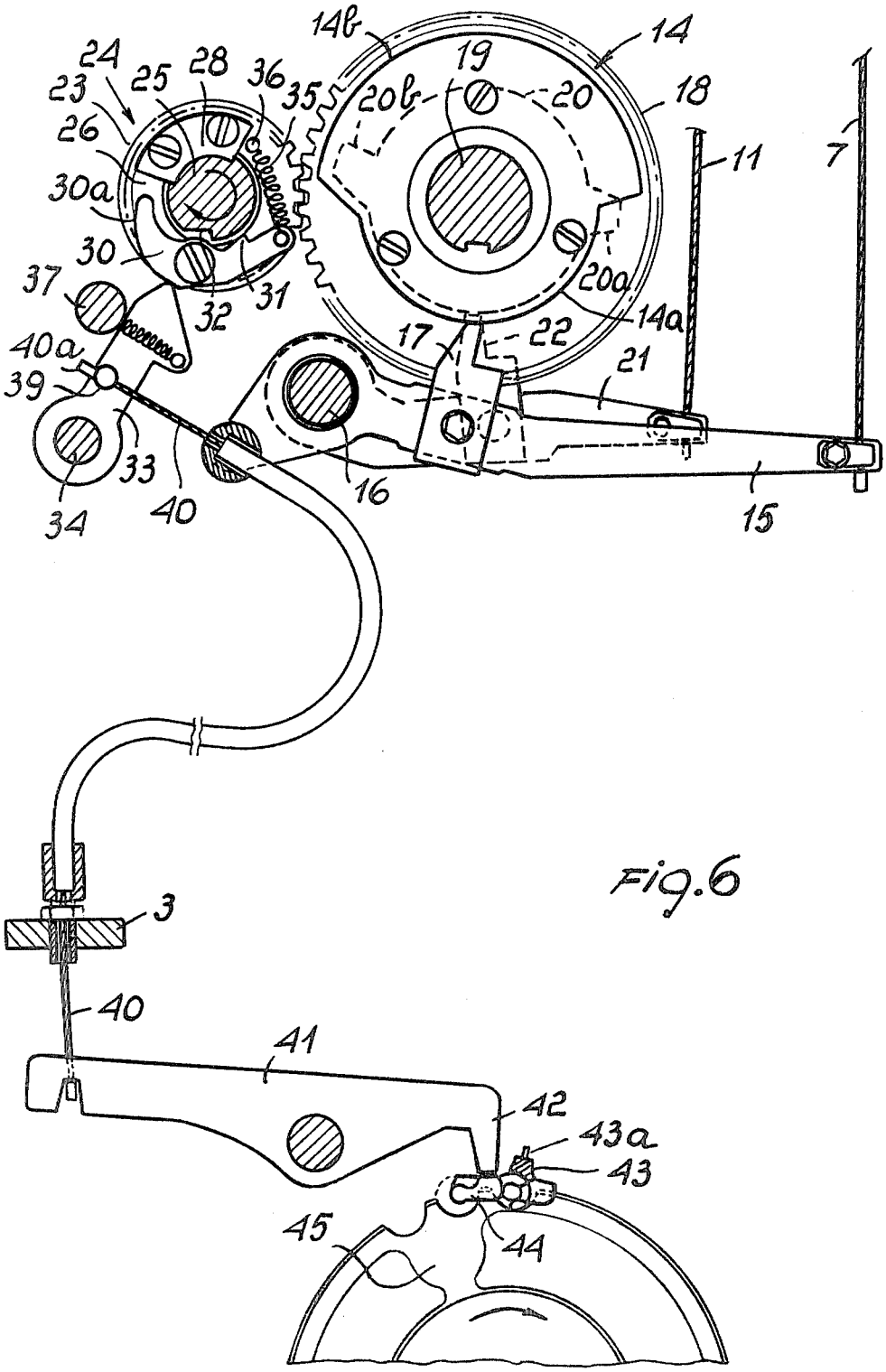

To bring the thread finger into its operative position (FIG. 5), a higher projection 43 of the machine main chain is active, e.g. provided with a dowel pin or the like 43*a*, i.e. such as to produce rotation of the lever 41 through a larger arc than that resulting from a normal projection 43, thus pulling on the cable 40 to separate the anchor 33 from the stop or detent 37. This involves release of the ratchet lever 30, the small tooth whereof, 31, under the action of the spring 35, snaps into the recess 32 as soon as the latter presents itself in front of it during the shaft 25 rotational movement. This in turn produces rotation of the actuator element 24, and consequent rotation of the toothed wheel 18 and disk 14, as shown in FIG. 5, until the tooth 17 is brought to the lower portion 14*a* of the disk 14, as shown in FIG. 6, thus releasing the cable 7 and bringing the corresponding thread finger to an operative position, as shown for the thread finger 5 in FIG. 1.

It should be noted that as the tooth 17 is about to move from the portion 14*b* to the portion 14*a* (FIG. 5), there further intervenes command on the lever 21 by the projection 20*a*, to partially pull on the cable 11 and release the gripping member such as to release the thread to be inserted in the knitting cycle.

In the meantime, however, the advancement of the machine main chain moves forward the projection 43 equipped with a dowel pin 43*a* or the like, thereby the lever 41 is returned to the position shown in FIG. 4, thus releasing the anchor 33 to its rest position. Thus, as soon as the edge 30*a* of the ratchet lever 30 presents itself once more before the anchor 33, it engages the same and the small tooth 31 is disengaged from the recess 32 and the actuator element 24, which has just completed one revolution, comes to a stop, the shaft 25 continuing to rotate. Therefore, the toothed wheel 18 and disks 14 and 20 are also stopped, and the thread finger is maintained in an operative position (FIG. 6) until it is again controlled to move out, whereas the cutting member is held inoperative.

When it becomes necessary to again move out of operation the thread finger being considered, a projection 43 on the machine main chain is caused to intervene which brings the lever 41 to a position such as to pull on the cable 40, thus separating the anchor 33 from the stop 37 and allowing the actuator element 24 to perform one rotation. It should be noted that this movement of the anchor 33 may be obtained through a normal projection 43 instead of a projection provided with a dowel pin 43*a* or the like, because in the present position of the lever 15, wherein the tooth 17 engages the lower portion 14*a* of the disk 14, the end of the lever 15 whereto the end of the sleeve of the cable 40 is attached is farther from the anchor 33 than it appears from FIG. 4 or 5, as the tooth 17 engages the high portion 14*b* of the disk 14. The end block 40*a* is, therefore, in close contact with the pin 39, thereby a smaller displacement of the lever 41 is sufficient to move the anchor 33 away from the stop 37. Thus, it will be apparent why, in the rest or inoperative position of the device (FIG. 4), a small excess cable length is required in the cable 40; in fact, lacking such excess length, one could not have the anchor 33 to assume its rest condition, neither as the tooth 17 engages the lower portion 14*a* of the cam 14 (FIG. 6), nor when it engages the high portion 14*b* of the cam 14 (FIG. 4,5 or 7).

Figure 7:
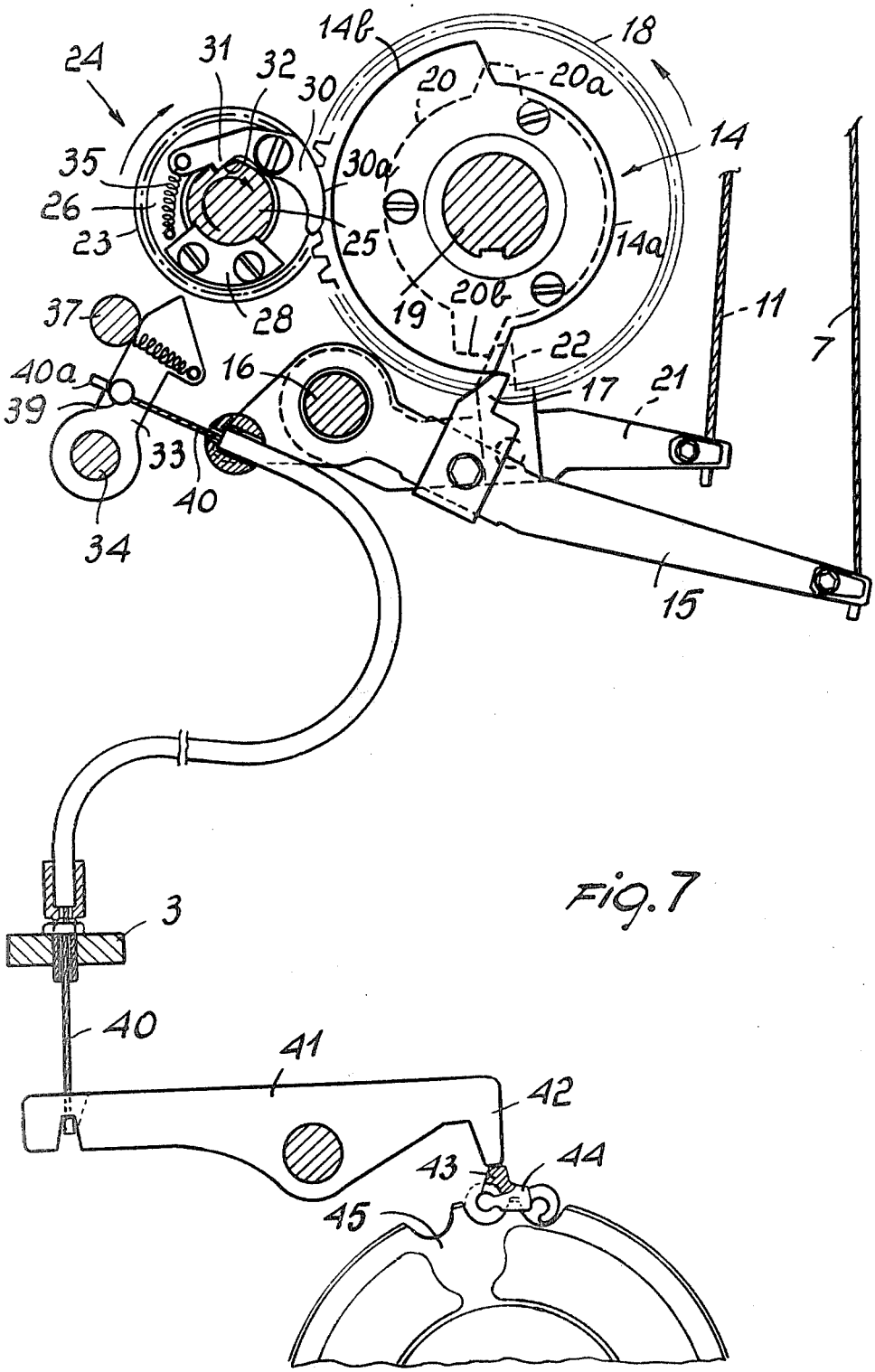

As, following rotation of the actuator element 24 and, accordingly, of the disk 14, the tooth 17 climbs the projection 14*b* of the disk 14, as shown in FIG. 7, then the lever 15 is rotated partially, to displace the end of the sleeve of the cable 40 attached thereto, thereby the anchor 33 is released and the actuator element 24 again stopped on completion of one revolution, i.e. as the ratchet lever 30 comes in contact with the anchor 33. At this moment, the advancing movement of the machine main chain causes the lever 41 to be released, and the starting or initial conditions shown in FIG. 4 are re-established.

It should be added, as relates to the thread cutting and gripping device, that simultaneously with the removal of the thread finger from the operative position, as shown in FIG. 7, the lever 21 is actuated by the tooth 22 climbing the projection 20*b*, which as mentioned above is higher than the projection 20*a*, such that, in addition to opening the gripping member, it ensures that the thread be caught in the cutting blade 10, which cutting blade, upon the tooth 22 falling back from the projection 20*b*, cuts the thread, which remains seized in the gripping member in a manner known per se.

It should be noted that the movements of the levers 15 and 21 occur at all times under the tension applied thereto by the cables 7 and 11, thereby no oscillation of the levers is produced and these follow the profiles of the cams 14 and 20 most accurately. Moreover, the stopping of the various members at the correct position is uncritical, by virtue of the abundant circumferential extension of the portions 14*a* and 14*b* of the disk 14, as well as of the lower or bottom portion of the disk 20. This prolonged extension, moreover, involves no constructional and timing problems.

In practicing the device according to the instant invention, it has been found suitable to brake to a certain extent the disks 14 and 20 and related toothed wheel 18, e.g. by means of cup springs, similar to those indicated at 46 in FIG. 3.

From the foregoing, it will be apparent that by arranging several elementary devices 13 one beside the other one obtains a complete control device, wherein each elementary device can be actuated independently, by providing rows of corresponding projections 43 or empty spaces on the machine main chain, which may have any suitable width. In the extreme, it is thus possible to actuate all of the thread fingers to operate concurrently, simply by causing the respective actuator elements 24 to become coupled with the common shaft 25.

The invention described hereinabove is susceptible of many modifications and variations, all of which are intended to fall within the scope of the instant inventive concept. Thus, for example, the coupling system between the actuator element 24 and shaft 25 could be different from the one described, as different could be the drive system from the actuator element 24 to the disks 14 and 20. Also, the number of the elementary devices may be any one. The programming chain formed with projections 43 could also be a chain separate from the machine main chain, and driven in timed relationship therewith or with the rotational speed of the cylinders. It will be further understood how the device just described may advantageously and quickly be added even to single cylinder circular knitting machines, for actuating the respective thread fingers and thread cutting and gripping means.

I claim:

1. A control device for striper units in a circular knitting machine having at least one rotatable needle cylinder and at least one thread feed comprising a plurality of thread fingers, the device comprising a plurality of first cam disks each corresponding to one of said thread fingers, a common shaft for supporting said first cam disks, control levers each having cam follower means constantly engaging a respective one of first cam disks and each operatively connected to a corresponding one of said thread fingers to control said corresponding one of said thread fingers between an operative thread feeding position and an inoperative thread withdrawing position, a plurality of actuating members each rigid with a corresponding one of said first cam disks, said first cam disks and said actuating members being axially non-displaceable on said common shaft, a plurality of revolvable actuator elements each in constant engagement with a respective one of said actuating members, a rotatable drive shaft for idly supporting said actuator elements, said drive shaft being rotatable at a rotational speed bearing a predetermined speed ratio to the rotational speed of said at least one rotatable needle cylinder, and means for selectively coupling said actuator elements with, and uncoupling from, said drive shaft for predetermined time lapses wherein the respective of said thread fingers are displaced between said operative thread feeding position and said inoperative thread withdrawing position according to a machine knitting program.

2. A device according to claim 1, wherein said at least one thread feed further comprises thread cutting and gripping means each having a thread cutting and gripping member and each being associated to a corresponding one of said thread fingers, and wherein said device further comprises a plurality of second cam disks each corresponding to one of said thread fingers and each rigid with a corresponding one of said actuating members, control levers each having cam follower means constantly engaging a respective one of said second cam disks and each operatively connected to a corresponding one of said thread cutting and gripping members, said second cam disks being rigid with corresponding of said first cam disks.

3. A device according to claim 2, wherein said first cam disks each have a profile comprising a projecting portion extending substantially along a 180° arc, and said second cam disks each have a profile comprising two projections substantially opposite to each other and of trapezoidal shape, said second cam disks being mounted with respect to said first cam disks at an angular position such that said two opposite projections are substantially at angular points whereat said projecting portion begins and ends.

4. A device according to claim 3, wherein said two projections have different heights.

5. A device according to claim 1, wherein said actuator elements and said actuating members each comprise a toothed wheel, the toothed wheels of corresponding actuator elements and actuating members being in mutual mesh engagement.

6. A device according to claim 1, wherein said rotatable drive shaft has a plurality of recesses each corresponding to one of said actuator elements and said actuator elements each comprise a disk mounted idly on said rotatable drive shaft and prevented from moving axially along said rotatable drive shaft, a ratchet lever journalled on said disk about a pivot axis substantially parallel to the axis of said disk, said ratchet lever having, on one side of said pivot axis, a small inner tooth adapted for engaging a corresponding one of said recesses to make said disk rigid with said drive shaft, and, on the opposite side of said pivot axis, an outer edge having a gradually increasing radius, and a rocking anchor capable of engaging said outer edge, said means for selectively coupling and uncoupling said actuator elements causing said rocking anchor to move into a position of engagement with said outer edge such as to keep said small tooth disengaged from said corresponding one of said recesses, and into a position of disengagement from said outer edge such as to bring said small tooth resiliently into a position of engagement with said corresponding one of said recesses.

7. A device according to claim 6, wherein said means for coupling and uncoupling said actuator elements comprise a programming chain having projections thereon arranged in rows according to a knitting program, a plurality of rocking levers for engaging said projections, each of said rocking levers being associated to a corresponding one of said actuator elements and adapted for engaging one of said rows, a Bowden cable between each of said rocking levers and said anchor of said corresponding one of said actuator elements, said Bowden cable having a sleeve having one end next to said anchor and connected to a corresponding one of said control levers and another end secured to a stationary machine structure.

8. A device according to claim 7, wherein said Bowden cable is secured to said anchor leaving a slight play, and that said programming chain has projections having two different heights.

* * * * *